5/29/84 OR 4,450,717

United States Patent [19]

Wiley

[11] 4,450,717

[45] May 29, 1984

[54] DOWNHOLE SAMPLING APPARATUS

[75] Inventor: Bruce F. Wiley, Bartlesville, Okla.

[73] Assignee: Phillips Petroleum Company, Bartlesville, Okla.

[21] Appl. No.: 377,499

[22] Filed: May 12, 1982

Related U.S. Application Data

[62] Division of Ser. No. 177,958, Aug. 14, 1980, Pat. No. 4,339,947.

[51] Int. Cl.[3] ..... E21B 49/04

[52] U.S. Cl. ..... 73/151

[58] Field of Search ..... 73/151; 166/55; 102/200, 202, 202.5, 202.7, 202.12

[56] References Cited

U.S. PATENT DOCUMENTS

| | | | |
|---|---|---|---|
| 2,973,713 | 3/1961 | Burton | 102/202 |
| 3,095,736 | 7/1963 | Rogers | 73/151 UX |
| 3,329,218 | 7/1967 | Bell | 166/55 X |

*Primary Examiner*—Jerry W. Myracle

[57] ABSTRACT

Provided is an apparatus for taking core samples from the side of a borehole which comprises a gun body having a transverse shooting bore, a projectile adapted to be shot from the bore, a tether for tethering the projectile to the gun body, and a permanent magnet for holding the projectile to the gun body at the end of the tether.

6 Claims, 8 Drawing Figures

DOWNHOLE SAMPLING APPARATUS

This is a divisional application of application Ser. No. 177,958, filed Aug. 14, 1980, now U.S. Pat. No. 4,339,947, issued July 20, 1982.

BACKGROUND OF THE INVENTION

The invention relates to taking samples from holes. In another aspect, the invention relates to taking a sample from the sidewall of a borehole.

In the exploratory probing of the earth with boreholes, it is economically desirable to utilize as small a borehole as possible to extract the desired information. For example, it is a mathematical certainty that four times as much earth must be displaced from a 4" borehole than from a 2" borehole of the same depth. A downhole tool suitable for taking samples from the side of a small diameter borehole would thus be desirable.

To obtain information of the strata traversed by the borehole, sidewall sampling tools are lowered into the borehole to the level of the formation to be investigated and hollow core-taking projectiles are shot into the formation. The projectile and contained core are withdrawn from the formation by retrieving means affixed to the sidewall sampling tool. The sidewall sampling tool is then raised to the surface and the core removed from the projectile for analysis. However, in the past the cores were frequently lost from the projectile during the raising of the sidewall sampling tool through the borehole due to impact of the projectile or sidewall sampling tool against the wall of the borehole. Besides necessitating an additional lowering of the sampling tool into the borehole to take another sample, it has proved frequently difficult to position the sampling tool adjacent the same formation from which the previous, unrecovered sample was taken. An apparatus for reliably transporting a sample from the stratum to the surface would thus be extremely desirable.

Generally, sidewall samplers comprise a plurality of bores containing projectiles backed by propellant charges. The propellant charge is ignited by an ignition device such as an igniter cap, which is electrically actuated. Use of an igniter device in a downhole sampling gun presents a hazard to personnel on site. Additionally, constructing the downhole sampling gun so as to employ an igniter device to ignite the charge greatly complicates fabrication of the downhole gun. It would also be extremely desirable to provide a downhole gun which does not employ an igniter device such as an igniter cap and which is simple and easy to fabricate.

OBJECTS OF THE INVENTION

It is an object of this invention to provide a sample-taking projectile adapted for reliably transporting a sample from a downhole formation to ground surface. It is a further object of this invention to provide a means for retrieving a sample taking projectile from a downhole formation to ground surface.

It is a further object of this invention to provide a downhole sample gun for reliably transporting a sample-taking projectile and sample from a down-hole formation to ground surface.

It is a further object of this invention to provide a downhole sample gun with a simplified wiring scheme that is simple and easy to construct.

It is a further object of this invention to provide a method for reliably retrieving a sample-taking projectile and sample from a downhole formation.

These and other objects of the invention will be made more clear from the following detailed description of the attached drawings and the claims.

SUMMARY OF THE INVENTION

According to one aspect of the present invention, a sample-taking projectile is provided having a sidewall, an end wall, and a sample chamber defined by the sidewall and end wall. At least one longitudinally elongated slot extends through the sidewall, establishing a pathway through the sidewall into the sample chamber. The slot provides pathway for fluid to escape from the sample chamber when the projectile is actuated. The slot further provides a means to fasten the projectile to a flexible retrieving means. By employing a projectile having a slot in its side, the projectile can be shortened from projectiles as employed in the prior art, which utilize a retreiving means fastened axially to the end wall of the projectile. This enables the downhole sampling gun to have a smaller diameter and it can therefore be employed in a smaller borehole, at great economic savings.

In another aspect, the present invention comprises a sample-taking projectile having a sidewall which defines a sample chamber, an opening at one end of the projectile leading axially into the sample chamber, a pair of opposed longitudinally elongated apertures leading through the sidewall radially into the sample chamber, a flexible means for tethering the projectile extending through the opposed longitudinally elongated apertures, and a means for anchoring the tethering means. In this aspect, the portion of the tethering means in the sample chamber presents minimal obstruction to the collection of a core when the projectile is deployed. As the sample fills the sample chamber, the tethering means is pushed along the slot to the rear of the chamber. As an additional advantage, the core can frequently be removed from the projectile simply by forcing the flexible tether to the front of the slot.

In another aspect, the present invention comprises a block adapted to be raised and lowered in a borehole and having at least one transverse shooting bore therein, and at least one permanent magnet mounted to the block spaced apart longitudinally with respect to the block from the shooting bore. In this aspect, the present invention provides a downhole means for fastening a sample-taking projectile at least a portion of which is constructed of a magnetically attractable material to the gun block, for reliable transport of the sample within the projectile to the surface.

In another aspect, the present invention comprises a block having a transverse shooting bore therein emptying into a longitudinally extending groove in the exterior surface of the block, with the dimensions of the groove being larger than the dimensions of the transverse shooting bore. In this aspect, the present invention provides a protected area for receiving a retrieved projectile to prevent impact between the projectile and gun body and/or the side of the borehole as the apparatus is raised from the borehole.

In another aspect, the present invention comprises a block having a plurality of parallel bores spaced apart along its length and extending in a transverse direction, each of the bores having a substantially closed end, a groove aligned radially with the closed ends of the bores, a second groove extending down the side of the block, and secondary bores extending between the secondary groove and the groove aligned with the closed ends of the bores between alternating transverse bores. In this aspect, the present invention provides means for routing ignition wiring to the propellant charges within the bores with minimal complication.

In another aspect, the present invention comprises a block adapted to be raised and lowered into a borehole and having a transverse shooting bore therein, a sample-taking projectile having a portion positioned in the bore and a portion extending from the bore, and a tether extending transversely through the portion of the projectile extending from the bore. In this aspect, the present invention provides an apparatus suitable for lowering into a borehole and taking a sidewall core sample.

In another aspect, the present invention comprises a block adapted to be raised and lowered into a borehole and having at least one transverse shooting bore therein, a sample-taking projectile having a portion positioned in the bore and a portion extending from the bore and positioned in a groove along the side of the block, a tether having a portion thereof positioned through the portion of the projectile which is positioned in the groove, means affixed to the block to anchor the tether, and a permanent magnet mounted to the block at about the length of the tether from the point at which the tether is anchored to the block. In this aspect, the present invention provides an apparatus for lowering into the borehole, taking a sidewall core sample, and reliably transporting such sample to the surface.

In another aspect, the present invention comprises a method for taking a sample from a borehole by lowering a sample gun into the borehole, firing a tethered sample-taking projectile from the sample gun into the side of the borehole, moving the sample gun longitudinally within the borehole to pull the projectile from the side of the borehole, and holding the projectile against the sample gun by means of a permanent magnet.

In another aspect a breach plug for a downhole sample gun is provided with structures adjacent its ends for mounting sealing fixtures.

DETAILED DESCRIPTION OF THE INVENTION

Figure 1:
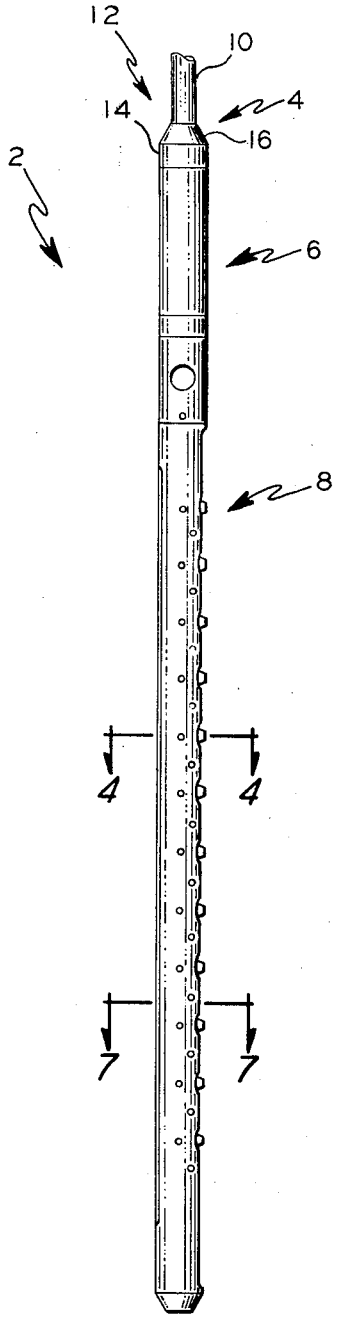
FIG. 1 is an elevational view of a sample-taking apparatus according to the present invention.
Figure 2:
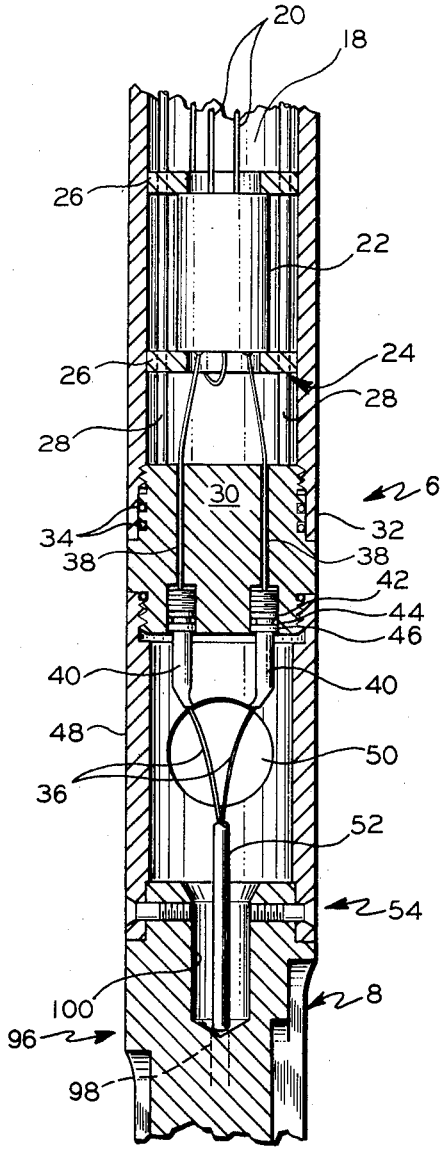
FIG. 2 is a fragmentary enlarged longitudinal sectional view of a portion of the apparatus of FIG. 1.

According to the invention, a downhole tool 2 (FIG. 1) is adapted to be raised and lowered into a borehole. The tool 2 comprises a cable affixation portion 4, a selector housing 6 and a gun body 8. A cable 10 , such as an armored cable, is affixed to the cable affixation portion 4 of the apparatus 2 by a suitable cable fitting 12. The cable fitting 12 is affixed to the selector housing 6 by any suitable means, for example, a threaded fitting. As shown, the cable fitting 12 has a generally cylindrical exterior surface 14 which is adjacent and has the same diameter as the exterior surface of the selector housing 6. The cable fitting 12 is further provided with a tapering surface 16, preferably frustoconical in shape, adjacent to and diverging from the cable 10 to prevent seizing of the apparatus as it is raised from the borehole. The selector housing 6 (FIG. 2) is preferably cylindrical in shape. As shown, it is provided with a passage 18 for electrical conductors 20. The electrical conductors 20 extend to the ground surface via cable 10. As shown, three electrical conductors 20 are present in passage 18. A first of the electrical conductors 20 is grounded to the tool 2. A second of the conductors 20 provides an indexing pulse to a rotary stepper 22. A third of the electrical conductors 20 provides a firing pulse to the rotary stepper 22. A suitable rotary stepper is a Roto-mite Stepper DC available from Guardian Electric Co., Chicago, Ill. The stepper 22 is mounted in the passage 18 by a suitable mounting means 24. As shown, the rotary stepper 22 is mounted coaxially with the passage 22 between a pair of annular bulkheads 26 which have a diameter to closely fit the inside diameter of the passage 18. The annular bulkheads 26 are retained in position by a pair of screws 28. The screws 28 are affixed to a water-tight bulkhead 30 at the lower end of selector housing 6. The water-tight bulkhead 30 forms a partition across the passage 18. The water-tight bulkhead 30 is threadably affixed to a lower end 32 of the selector housing 6. Annular seals 34, for example, 0-rings, enhance the water resistant structure between bulkhead 30 and the lower end 32 of the housing 6.

As shown, a plurality of electrical conductors 36 extend from the lower end of the rotary stepper 22 and through the bulkhead 30. Typically, the rotary stepper 22 is provided with a plurality of terminals spaced annularly and extending axially from the lower end of the stepper 22. Each of the electrical conductors 36 carries a firing pulse to a respective one of a plurality of propellant charges in the gun body 8. The electrical conductors 36 feed through the bulkhead 30 via bulkhead passages 38. The bulkhead passages 38 extend longitudinally through the bulkhead 30. A sealing means is provided between each of the electrical conductors 36 and the wall of the passage 38. As illustrated, a plurality of bulkhead feedthroughs 40 are connected to each of the conductors 36 and extend partially through the passage 38. Each of the bulkhead feedthroughs 40 are provided with an annular flange 42, an annular seal 44, for example an 0-ring, against the annular flange 42, and a packing nut 46 adjacent the annular seal 44 threaded to the feedthrough 40 adapted for longitudinally compressing the seal 44 and expanding it in a radial direction to closely fit the passage 38.

If desired, an observation housing 48 can be threadably affixed to the lower end of bulkhead 30. As shown, the observation housing 48 has a pair of ports 50 through its sidewall, with the conductors 36 being visible through the ports 50. As shown, the electrical conductors 36 come together in a lower portion of the observation housing 48 to form a wiring bundle 52, which is axially disposed within the passage through the observation housing 48.

The gun body 8, as shown, is affixed to the lower end of the observation housing 48 by a suitable means, such as the joint and set screw arrangement 54 as shown. Preferably, the gun body 8 comprises a block having transverse shooting bores therein. Usually, the gun body 8 is formed from cylindrical stock and is elongated in shape. It is desirable to fabricate the gun body from a non-magnetic material, such as 304 or 316 stainless steel. Broadly, the gun body is provided with a means for receiving a projectile and propellant charge and transporting same into the borehole; a means for igniting the propellant; and a means for retrieving the projectile and sample and transporting same to the surface of the earth. As shown, the means for receiving the projectile and propellant charge and transporting them into the borehole comprises the transverse shooting bore 56 (FIG. 3) which extends partially through the gun body.

The transverse bore 56 is at least partially sealed and substantially closed at one end by a plug 58. The plug 58 has a passage 64 therethrough extending along its longitudinal axis from its first end 90 to its second end 91. The passage 64 is defined by a generally cylindrical inside surface 68 extending from the first end of the plug. The passage broadens from the first end into a propellant chamber defined by a generally cylindrical inside surface 62 via a frustoconical inside surface 57. The portion of passage 64 defined by surface 68 and 57 is at least partially filled with a mass 70 of sealant material, preferably epoxy cement or the like because of cost. The portion of passage 68 defined by the inside surface 62 contains a propellant charge 63. The propellant charge 63 is preferably a smokeless gunpowder. For example, Hercules Bullseye pistol powder has been employed with good results. The passage 64 is provided with a generally cylindrical inside surface 67 adjacent its second end which is separated from the smaller diameter surface 62 by an annular shoulder 69. A disc 71 annularly contacts the surface 67 and abuts against the shoulder 69 to seal the propellant charge 63 at the second end 91 of the plug 58. The disc is constructed of any suitable material, for example, brass. The exterior surface of plug 58 is divided into a first generally cylindrical surface 73 extending from the first end of the plug, an annular shoulder 75 extending between surface 73 and a second, smaller diameter generally cylindrical surface 77, and an annular shoulder 79 extending between the surface 77 and a third, smaller diameter generally cylindrical surface 61, which is provided with a threaded portion. An annular seal, such as O-ring 80, annularly contacts the surface 77 and abuts shoulder 75. A first electrode 66 is axially disposed in passage 64 and extends from the first end of the plug 58 partially to the second end. A second electrode 81, preferably parallel to the first, extends from surface 57 partially to the second end. Electrodes 80 and 81 can be constructed from any suitable material, for example, #18 magnet wire has been employed with good results. A third electrode 83, which is in contact with and ignites the propellant charge 63 is affixed between electrodes 80 and 81. Electrode 83 can be constructed of any material which provides sufficient heat to ignite the propellant charge 65, for example, #38 nickel wire without a coating of priming charge has been employed with good results. Preferably, the first end of the plug 58 is provided with fittings, such as boreholes 85, for accepting a wrench, such as a spanner wrench.

A projectile 60 is mounted in the transverse borehole 56 adjacent the second end of the plug 58. Preferably, the borehole 56 is defined by a sleeve 72, constructed of any suitable material, such as, for example, 17-4PH stainless steel. The sleeve 72 is mounted in a suitable borehole 74 and is tapped for accepting the plug 58. Preferably, the borehole 74 is provided with an annular shoulder 76 which contacts an annular shoulder 78 of the sleeve 72. The annular shoulder 78 of the sleeve 72 faces generally toward the end of the borehole containing the plug 58. The O-ring 80 is compressed between the shoulder 75 of the plug 58 and an end surface 87 of the sleeve 72. The shoulder 79 of the plug 58 abuts the end surface 87 of the sleeve 72.

Figure 6:
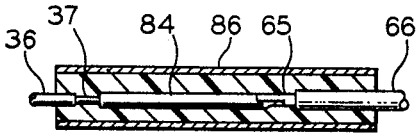
FIG. 6 is an enlarged fragmentary longitudinal sectional view of a feature of the present invention as shown in FIG. 5.

The means for igniting the propellant charge 63 comprises the electrical conductor 36 (FIG. 6). The electrical conductor 36 is attached to the electrode 66 via a sealed ferrule arrangement, as shown in FIG. 6. A lead 37 from the conductor 36 is affixed into one end of a ferrule 84 and a lead 65 from electrode 66 is received by the other end of the ferrule 84. The ferrule 84 is formed from a conducting material, for example, brass. The electrode 66 has an insulated covering protecting that portion of it which is positioned outside of the breach plug 58. A length of heat-shrinkable tubing 86, shown in its expanded configuration, encases the bare ends of conduit 36 and electrode 66 and the ferrule 84 and protects against accidental grounding.

Figure 7:
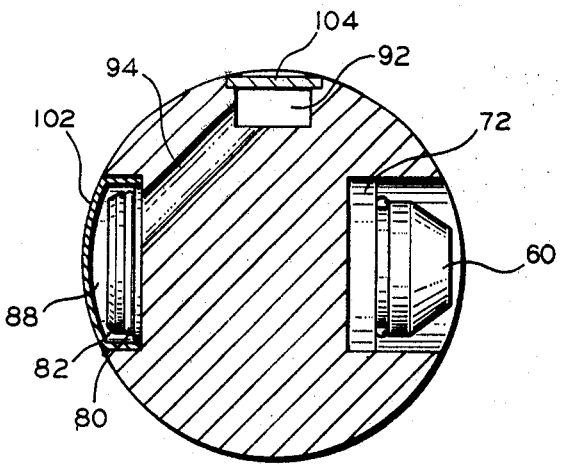
FIG. 7 is an enlarged transverse sectional view of the apparatus as taken along the indicated lines of FIG. 1.

An elongated longitudinally extending groove or slot 88 is provided on the exterior of the gun body 6 (FIG. 7). The ferrule connection 84 is positioned in the groove 88. To achieve this end, the electrode 66 is bent through an angle of about 90° adjacent an outside wall of an enlarged end 82 of the breach plug 58. The groove 88 is aligned with the breach end of bore 56. As shown, the enlarged end 82 of the breach 58 is positioned in the bottom of the groove 88. As shown in FIG. 7, the electrical conductor 36 is routed to a secondary elongated longitudinally extending groove 92 in the exterior of the gun body 8 via a borehole 94 which establishes a communication between the groove 88 and the groove 92. Boreholes 94 are positioned between alternate transverse shooting bores 56. A pair of conductors 36 are passed through each of the boreholes 94. One of the electrical conductors leads to the transverse shooting bore 56 above the borehole 94, the other electrical conductor leads to the transverse shooting bore 56 below the borehole 94. The conductors 36 can be color-coded to prevent confusion. In the groove 92, the electrical conductors come together to form the bundle of wires 52 which pass upwardly in the groove 92 to an upper end 96 of the gun body 8. A borehole 98 inclined with respect to the longitudinal axis of the gun body 8 establishes a pathway between the elongated groove 12 and an axial borehole 100 in the upper end 96 of the gun body 8. The wire bundle 52 is routed from the groove 92 through the inclined borehole 98, the axial borehole 100, and into the observation housing 48 and from there to the rotary stepper 22 as previously described. It is preferred that a cover structure 102 cover the longitudinal groove 88. The cover structure 102 can be affixed to the gun body in a covering relationship with the groove 88 by any suitable means, for example, by screws. It is also preferred that the groove 92 be covered with a cover structure 104. The cover structure 104 can be affixed to the gun body 8 by any suitable means, for example by screws.

Figure 8:
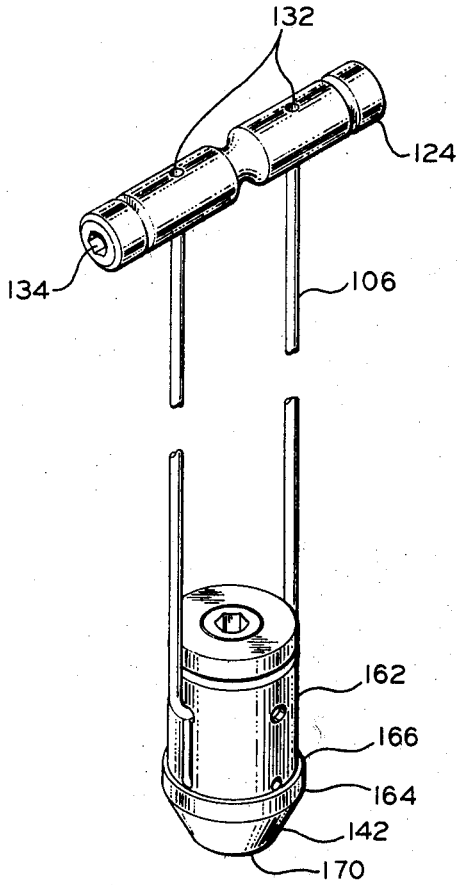
FIG. 8 is a detailed elevational view of a portion of the apparatus ilustrated in FIG. 3.

The flexible means for retrieving the projectile 60 comprises a flexible tether 106 (FIG. 8) which is affixed to the projectile 60 and to the gun body 8 via a tether anchoring means 114. Preferably, the tether is affixed to the gun body 6 at a position below the transverse shooting bore 56. The tether 106 is affixed to the projectile 60 through an elongated slot 108 in the sidewall of the projectile. The tether 106 has a tethering length defined by the radius scribed by the projectile when swung around the position on the gun body to which the tether is affixed. The tether 106 can be coiled on the exterior of the gun body 8, preferably within a groove 112, into a coil 110 (FIG. 3) as shown.

Preferably, the gun body 8 is provided with an elongated longitudinally extending groove 112 in its exterior surface which is aligned with the transverse shooting bore 56. At about a tethering length from the tether anchor 114, the groove 112 has a sufficient width and depth to receive the projectile 60. Normally, the width and depth of the groove 112 at this position will be greater than the diameter of the shooting bore 56. Preferably, a permanent magnet 116 is provided at that position in the groove 112. The magnet 116 is affixed to the gun body 8, preferably partially in a recess 118 in the bottom of groove 112 by any suitable means, for example, by cement. Preferably, the magnet 116 is in the form of a disc with an end surface 120 protruding slightly from the bottom surface of the groove 112. More preferably, the magnet 116 is provided with a groove 122 in its end surface 120 which is in longitudinal alignment with the longitudinal axis of gun body 8. Providing the magnet with a groove increases the magnetic forces available for fastening the projectile 60 for transport to ground surface. A suitable magnet is available from Arnold Engineering, Marengo, Illinois.

Figure 3:
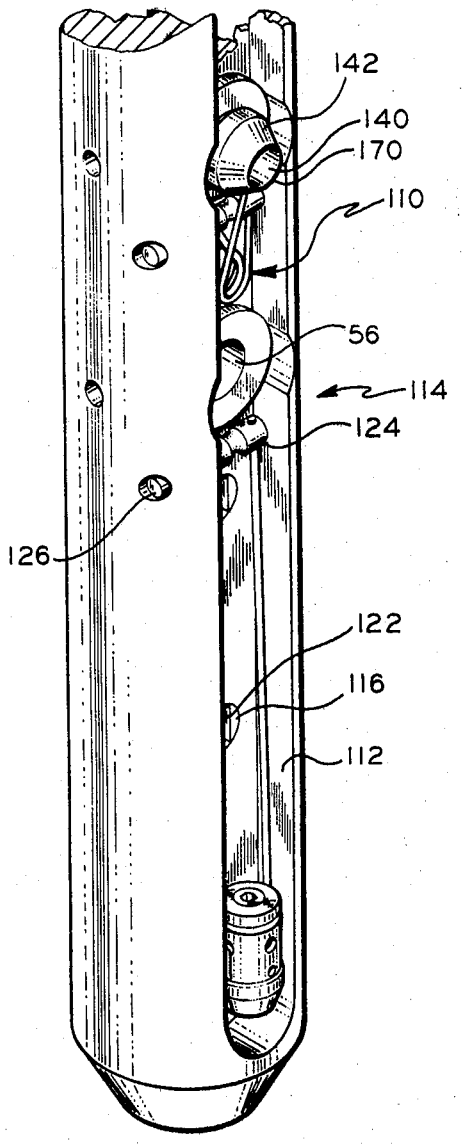
FIG. 3 is a fragmentary enlarged elevational view of a portion of the apparatus as seen in FIG. 1 taken from a different perspective.

Preferably, the tether anchor 114 comprises an elongated body 124, for example, a pin, which is mounted transversely across the groove 112. As shown, the pin 124 is mounted in a suitable bore 126 extending from the sidewall of the groove 112 to the cylindrical exterior surface of the gun body 8. As shown, the pin 124 is rotatably mounted in the borehole 126. The pin 124 has a pair of transverse bores 132 (FIG. 8) therethrough each of which contain a portion of the tether 106. The pin 124 is positioned within bore 126 so that the apertures 132 are positioned within the elongated groove 112. Each of the apertures 132 in the pin 124 receive and firmly engage a portion of the tether 106. As shown, a set screw 134 mounted in a longitudinal passage from each end of the pin 124 presses against the portion of the tether 106 positioned in the transverse borehole 132. For compactness, it is preferred that the tethering length of the tether 106 be greater than the distance between adjacent shooting bores 56 in the gun body 8. As shown in FIG. 3, by providing most of the gun body with a serial shooting bore, pin, magnet arrangement, wherein a pair of magnets are positioned in the groove 112 intermediate the anchoring means 114 and the magnet 116 which is at a tethering length from the tether anchor 114, the apparatus can be longitudinally compacted and advantageously employed with a firing order from the bottommost shooting bore 56 up.

The projectile 60 (FIG. 4) is provided with a sidewall 136 which partially defines the sample chamber 138. An opening 140 in one end of the projectile leads axially into the sample chamber 138. The projectile 60 is equipped with at least one elongated aperture or slot 108 (FIG. 5) through its sidewall communicating with the sample chamber 138. Preferably, a pair of opposed slots 108 are provided in the sidewall 136 of the projectile 60 which are separated by an angle of about 180° with respect to the longitudinal axis of the projectile 60. In this embodiment, the pair of opposed slots 108 establish a transverse pathway through the projectile 60. The tether 106 extends through the transverse pathway.

Figure 5:
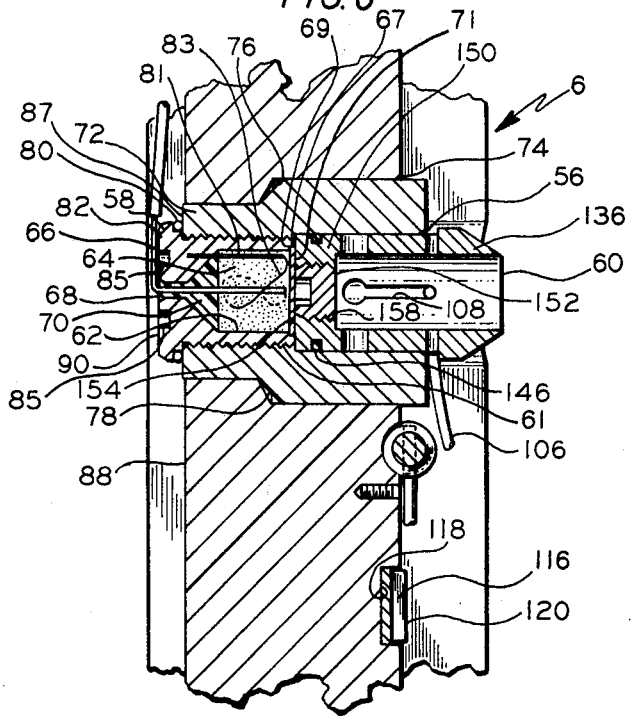
FIG. 5 is a fragmentary longitudinal sectional view of the features as shown in FIG. 4 taken along the indicated lines.
Figure 4:
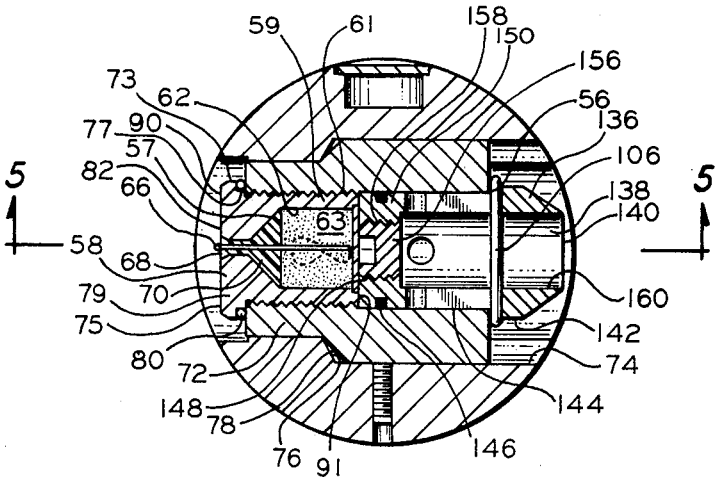
FIG. 4 is an enlarged transverse sectional view of the apparatus of FIG. 1 taken along the indicated lines.

In the loaded position, as shown in FIGS. 3, 4 and 5 a portion 142 of the projectile 60 protrudes from the transverse shooting bore 56 in the gun body 8 (FIG. 3). A portion 144 of the projectile 60 is positioned within the transverse shooting bore (FIG. 4). Preferably, an annular seal 146, such as an O-ring, extends around the portion 144 of the projectile in the transverse borehole 56 preferably near closed end 148 of the projectile 60. In this embodiment, a portion of the elongated slot 108 is positioned in the groove 112, and a portion is positioned within the transverse shooting bore 56. The tether 106 passes through the transverse passageway defined by the portion of the elongated slots 108 positioned in the groove 112. A portion of the tether abuts the gun body 8.

The closed end 148 of the projectile 60 is defined by an end wall 150 having an inside surface 152 and an outside surface 154. The outside surface 154 of projectile end wall 150 abuts the disc 71. The inside surface 152 of the projectile end wall 150 partially defines the sample chamber 138. As shown, the projectile end wall 150 is further provided with a removable plug 156 which is mounted in an aperture 158 extending from the outside surface 154 to the inside surface 152 of the projectile end wall 150. Preferably, the plug 156 and aperture 158 are provided with mating threaded surfaces. It is preferred that the elongated slots 108 extend from adjacent the inside surface 152 of the projectile end wall 150 toward the open end 140 of the projectile 60. As illustrated, the projectile is provided with a generally cylindrical interior surface 160 defining a bored sample chamber 138. The exterior surface of the projectile is divided into a generally cylindrical portion 162 beginning at the closed end 148 of the projectile 60, a second generally cylindrical portion 164 having a larger diameter than the generally cylindrical portion adjacent the closed end 148 of the projectile 60, a generally annular portion defining a shoulder 166 between the two generally cylindrical portions, and a frustoconical portion 168 extending from the larger generally cylindrical portion 164 to an annular cutting edge 170 defined by the intersection between the frustoconical portion 168 and the generally cylindrical interior surface 160 of the projectile 60. Preferably, the transverse slot 108 terminates adjacent the shoulder 166 and the projectile is positioned in the transverse shooting bore 56 so that a portion of the tether 106 is between the annular shoulder 166 and the gun body 8.

In operation, the propellant charge is placed in the transverse shooting bore. The projectiles are loaded into the transverse shooting bores. The tethers are coiled in a position and affixed to the anchor means. The electrical conductors are affixed to the electrodes embedded in the propellant charge and sealed. The cover plate covering the conductor electrode connectors is installed. The sample gun carrying the tethered sample-taking projectiles is then lowered into a borehole to a desired depth. The projectiles are fired from the sample gun at the desired depth in the borehole, beginning with the lowermost projectile. After each projectile is fired, the sample gun is moved longitudinally, preferably upwardly in the borehole to pull the sample-taking projectile from the side of the borehole by the tether. The projectile swings by the tether into the groove 112 and is fastened to the sample gun by the magnet. After the desired number of samples have been taken, the sample gun is raised from the borehole, and the samples are removed from the projectiles and analyzed as desired.

It is to be understood that while I have illustrated and described certain forms of my invention, it is not to be limited to the specific form or arrangement of parts herein described and shown.

That which is claimed is:

1. Apparatus comprising:

(a) a plus having a first end and a second end and a longitudinal axis extending from the first end to the second end, said plug having a passage extending along its longitudinal axis from its first end to its second end defined by a first generally cylindrical inside surface extending from the first end of the plug, a second generally cylindrical inside surface defining a larger diameter than the first generally cylindrical inside surface extending from the second end of the plus toward the first end of the plug, a third generally cylindrical inside surface defining a diameter intermediate the diameter of the first generally cylindrical inside surface and the diameter of the second generally cylindrical inside surface between the first generally cylindrical inside surface and the second generally cylindrical inside surface, a generally frustoconical inside surface diverging from the first generally cylindrical inside surface to the third generally cylindrical inside surface, and an annular shoulder between the third generally cylindrical inside surface and the second generally cylindrical inside surface, and an exterior surface defined by a first generally cylindrical exterior surface extending from the second end of the plug toward the first end of the plug, said first generally cylindrical exterior surface being provided with a threaded portion, a second generally cylindrical exterior surface having a larger diameter than the first generally cylindrical exterior surface extending from the first end of the plug toward the second end of the plug, a third generally cylindrical exterior surface having a diameter intermediate the diameter of the first generally cylindrical surface and the second generally cylindrical surface between the first generally cylindrical surface and the second generally cylindrical surface, a first exterior annular shoulder intermediate the first generally cylindrical surface and the third generally cylindrical surface, and a second exterior annular shoulder intermediate the third generally cylindrical surface and the second generally cylindrical surface;

(b) a first electrode positioned along the longitudinal axis of the passage from the first end partially to the second end;

(c) a second electrode parallel to the first electrode extending from the frustoconical inside surface partially to the second end; and (d) a third electrode extending between the first electrode and the second electrode.

2. Apparatus as in claim 1 further comprising a mass of sealant material positioned annularly between the first electrode and the first generally cylindrical inside surface and the first electrode and at least a portion of the generally frustoconical inside surface.

3. Apparatus as in claim 2 further comprising a mass of propellant contacting the third electrode.

4. Apparatus as in claim 3 further comprising a disc annularly contacting the second generally cylindrical inside surface and abutting the annular shoulder between the second generally cylindrical inside surface and the third generally cylindrical inside surface.

5. Apparatus as in claim 4 further comprising an O-ring contacting the second generally cylindrical exterior surface and the second exterior annular shoulder.

6. Apparatus as in claim 5 further comprising a spanner wrench fitting at the first end.

* * * * *